United States Patent [19]

Prödel

[11] 3,986,628

[45] Oct. 19, 1976

[54] BOTTLE PACKING

[76] Inventor: Ulrich Heinrich Prödel, Grunstrasse 13, 4902 Bad Salzuflen, Germany

[22] Filed: Sept. 6, 1974

[21] Appl. No.: 503,930

[30] Foreign Application Priority Data

Sept. 25, 1973 Germany ..... 2348082

[52] U.S. Cl. ..... 220/21; 206/194; 206/203; 206/427; 217/19

[51] Int. Cl.[2] ..... B65D 1/24; B65D 75/00; B65D 85/00

[58] Field of Search ..... 220/21; 217/19; 206/203, 194, 427, 197, 193, 168, 169, 162, 507

[56] References Cited

UNITED STATES PATENTS

| | | | |
|---|---|---|---|
| 2,821,327 | 1/1958 | Glazer | 217/19 |
| 2,830,729 | 4/1958 | Brackett | 220/21 |
| 2,886,202 | 5/1959 | Waller | 220/21 |
| 3,392,875 | 7/1968 | Bockensteffe | 206/507 |
| 3,587,915 | 6/1971 | Theobuld | 206/203 |
| 3,762,594 | 10/1973 | Utz | 220/21 |
| 3,819,044 | 6/1974 | Bockensteffe | 206/507 |
| 3,863,759 | 2/1975 | Prodel | 220/21 |

FOREIGN PATENTS OR APPLICATIONS

| | | | |
|---|---|---|---|
| 1,488,661 | 6/1967 | France | 220/21 |

*Primary Examiner*—George E. Lowrance
*Attorney, Agent, or Firm*—Robert E. Burns; Emmanuel J. Lobato; Bruce L. Adams

[57] ABSTRACT

A bottle packing comprises a plastic bottle case receiving a plurality of cardboard or plastic bottle carriers. The case is divided by wedge-like compartment walls having sloping sides in which cutouts are provided to receive lower portions of bottles. The bottle carriers have a narrow bottom and sloping sides conforming to the compartment walls of the case and likewise having cutouts for the bottles. The carriers may also have cutouts for upper portions of the bottles and cutouts near the top to provide a handle. The carriers may receive one or two rows of bottles. The bottles can be placed in the case with or without carriers. When no carriers are used, the compartment walls prevent the bottles from striking one another.

14 Claims, 12 Drawing Figures

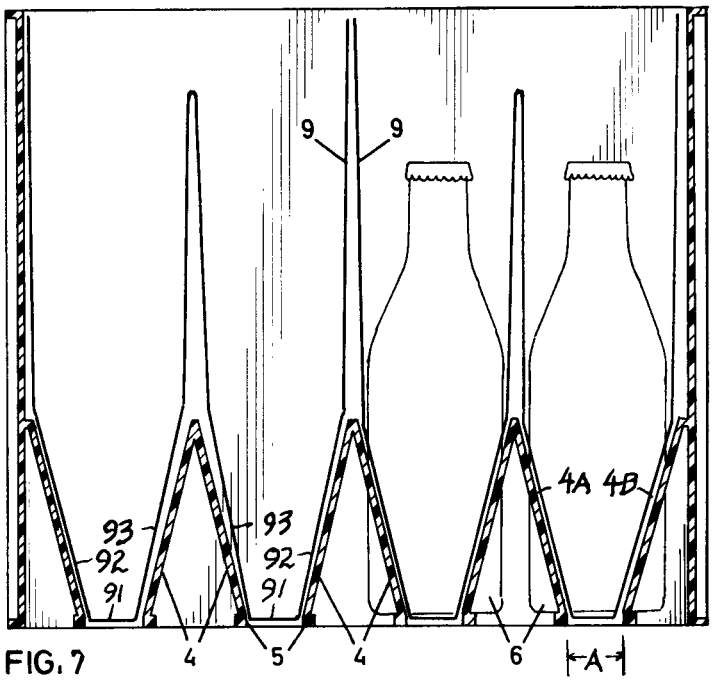
FIG. 7
FIG. 8
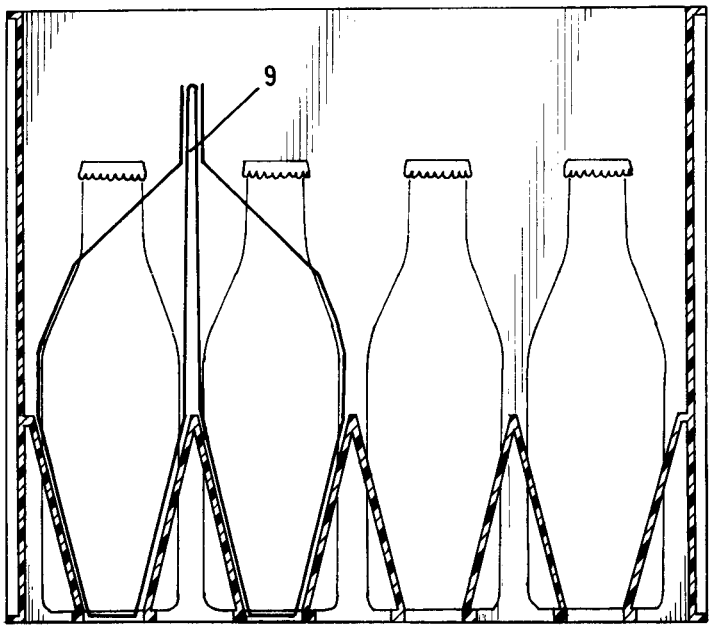

BOTTLE PACKING

The present invention relates to a bottle packing consisting of a plastic bottle case and bottle carriers which can be inserted therein and receive a part of the bottles which can be placed in the plastic bottle cases.

Beer bottles are brought on the market in various forms of packaging. One form of packaging is the plastic bottle case which can contain 24 beer bottles and serves both for the transportation of the full bottles of beer from the brewery to the foodstuff dealer, tavern or inn and for the return transportation of the empty beer bottles. Such plastic cases are used in large number. This proves that they have been found satisfactory. However, they have the disadvantage from the standpoint of technique of use that the beer bottles must be removed one by one at the sales points and must then be carried in carrying containers of the buyer from the point of sale to the consumer.

In order to remedy this drawback, numerous breweries have changed over to placing their beer bottles in cardboard carriers and placing several cardboard carriers in a corrugated cardboard carton. These corrugated cardboard cartons then serve for the transportation of the cardboard carriers filled with full bottles from the brewery to the point of sale. There the cardboard carriers are removed and serve the buyer as packaging means for the transportation of the beer bottles from the point of sale to the place of consumption. The best known of these cardboard carriers are those which contain six beer bottles. They have a bottom and two side walls which are connected with each other at their upper end and have a handle hole there. The side walls are provided at the place where they pass into the bottom with three cutouts each into which a part of the transition of the bottom of the bottle into the cylindrical wall of the bottle is inserted. Furthermore, the side walls each have three cutouts at the top into which the bottle neck together with the crown cork is inserted.

This bottle packaging is also widely used, although it has very important disadvantages:

One disadvantage is that the empty bottles cannot be transported back to the brewery without damage, since the bottles placed in the corrugated cardboard carton strike against each other during transportation. The damage to the bottles is so great that bottles packed in these cardboard carriers are used only as disposable bottles and thus are not taken back. This has the disadvantage that for each bottling, new bottles must be used, which results in very considerable expenses. Another disadvantage accures to the consumer due to the increased amount of rubbish resulting from the throw-away bottles.

Another disadvantage is that the packing of the bottles by machine into the cardboard carrier and of the cardboard carriers into the corrugated cardboard carton has considerable inherent difficulties.

The present invention avoids these disadvantages. The object of the present invention is so to shape the case and bottle carriers in the case of a bottle packaging which consists of a plastic bottle case and bottle carriers which can be placed therein that the bottles can be inserted by traditional automatic packing machines simultaneously into bottle carriers and plastic bottle cases.

The invention achieves this objective in the manner that the shape of the central and lower parts of the bottle carrier is adapted to the shape of the compartment walls of the bottle case. Preferably the shape of the central and lower portions of the bottle carriers is the same as the shape of the compartment walls of the bottle case.

When this is so, then prior to the filling of the plastic bottle case with bottles, the cardboard carriers can be placed open in the plastic bottle cases and the plastic bottle case then allowed to enter the packaging machine in which the plastic bottle case is filled with bottles. In this way, the result is obtained that plastic bottle case and cardboard carriers are provided simultaneously with full bottles.

It is particularly advantageous in this connection that after the filling of the plastic bottle case and of the cardboard carrier, no further operations are necessary if the cardboard carriers are so shaped that they can be grasped at the upper end by the customer in the same manner as a bag. With this development, the cardboard carriers after being filled with bottles are thus not stapled together at their upper end in the brewery in order to form a closed carrier, but the customer can himself effect the closing of the carrier at the point of sale by bending the side walls against each other and inserting his hand into the hand-grip holes.

This has the advantage that the bottles need not be sold at the point of sale in a six-pack together with the cardboard carrier, since a sale even of individual bottles is possible without opening the carrier.

It has proven particularly suitable for this bottle package to use a bottle case of plastic compartment walls of which are arranged at an acute angle to the vertical and have downward-widening bulges or recesses to receive the bottles.

For each row of bottles in these bottle cases, two compartment walls are provided. It is advisable for these compartment walls to have a rib at their lower end on which the bottles then sit.

With this construction, the bottles extend through the plane of the compartment walls and their support is assured by the bulges or recesses. This has the advantage that the compartment walls need extend merely from one side wall to the opposite side wall and need not be provided in addition with transverse compartment walls.

It may be advisable to have the compartment walls pass at an acute angle into the side walls. It will also be advisable in many cases for the tops of the compartment walls to touch each other at an acute angle within the case. In this manner a simple shape of the box which is easy to keep clean is obtained.

If the individual compartment walls are further to be connected to each other in the region of the bottom, this can be done by ribs which extend transversely to the compartment walls. These ribs are then arranged in such a manner that they are arranged in the region of the bottom of the bottles to be inserted in the case.

The bottle carrier of cardboard intended for these bottle cases can advisedly be shaped in the manner that the bottom is narrower than the width of one bottle bottom and that the side walls which have a hand-grip hole at their upper end have cutouts which taper upward from the bottom. This bottle carrier is so shaped that the bottom has a width which corresponds to or is smaller than the distance apart of the lower edges of the compartment walls. The bottle carrier is made of a one-piece cardboard blank. It is inserted into the bottle case before the filling of the bottle case. If the bottle case has been filled with full bottles, then with this bottle carrier it is merely necessary to grasp the upper end of the two side-walls in order to transport the bottles. This bottle carrier is intended for a row of bottles — whether three bottles or four bottles.

However, one can also use bottle carriers of cardboard by means of which two rows of bottles or more than two rows of bottles can be transported. Such a cardboard blank which serves as a bottle carrier then has two side walls, two middle walls and two bottoms. Each bottom serves for one row of bottles. Adjoining each bottom on one side is a side wall and on the other side a central wall. The two central walls are connected with each other at their upper ends. When the cardboard blank consists of a single piece of cardboard, there is a fold line provided at the place where the two central walls come together.

It is advisable, if, in addition to the cutouts in the lower region which partially surround the lower part of the bottles, there are provided in the upper part of the cardboard blank further cutouts which serve to receive the heads and necks of the bottles and which are adapted to the shape of the bottle heads and necks.

In the case of a bottle carrier for two rows of bottles, it is advisable for the cardboard blank to have these cutouts for the bottle heads and necks only on the two side walls. In the case of such a bottle carrier, it is advisable for the distance of the hand-grip-holes from the bottom to be somewhat smaller at the central walls than at the side walls.

The bottle case of this construction is, however, not suitable merely for the placing therein of cardboard blanks which then serve as cardboard carriers, but bottle carriers of plastic can also be placed in it, provided merely that the shape of the central and lower parts of the bottle carrier is adapted to the shape of the compartment walls of the bottle case. In connection with such a bottle carrier of plastic, it is advisable for it to have two central walls with cutouts each having a hand-grip hole, two bottoms and two side walls which are shorter than the central walls. The side walls are also provided with cutouts. The carriers can be inserted one within the other.

In this way there is created a bottle packing of universal use. The bottle case described is suitable for the transportation of empty and full bottles without bottle carriers. It is suitable for the simultaneous transportation of full and empty bottles together with cardboard or plastic carriers. However, it is also suitable for the transportation of disposable bottles.

Since the bottle case has extremely great stability due to the oblique compartment walls — they extend at an acute angle to the vertical — it is possible — if the compartment walls are fastened to the narrower side walls — completely to dispense with large portions of the longer side walls. The bottle case then consists only of two side walls on the narrow sides, of four corner columns which adjoin the side walls, and of the compartment walls. Since the compartment walls generally will have only half the height of the side walls, there is in this way created a bottle case which can be stacked empty in a particularly space-saving manner if one bottle case is stacked — turned upside down and turned 90° — on another bottle case.

The essence of the present invention will be explained in further detail with reference to an illustrative embodiment shown schematically in the accompanying drawing in which:

FIG. 7 is a section through a bottle case the left portion of which is provided merely with the cardboard carrier before the filling thereof with bottles and the righthand portion of which is filled both with the cardboard carrier and with bottles;

FIG. 8 is a similar section showing in the lefthand part a closed cardboard carrier and in the righthand part bottles without carrier;

Figure 1:
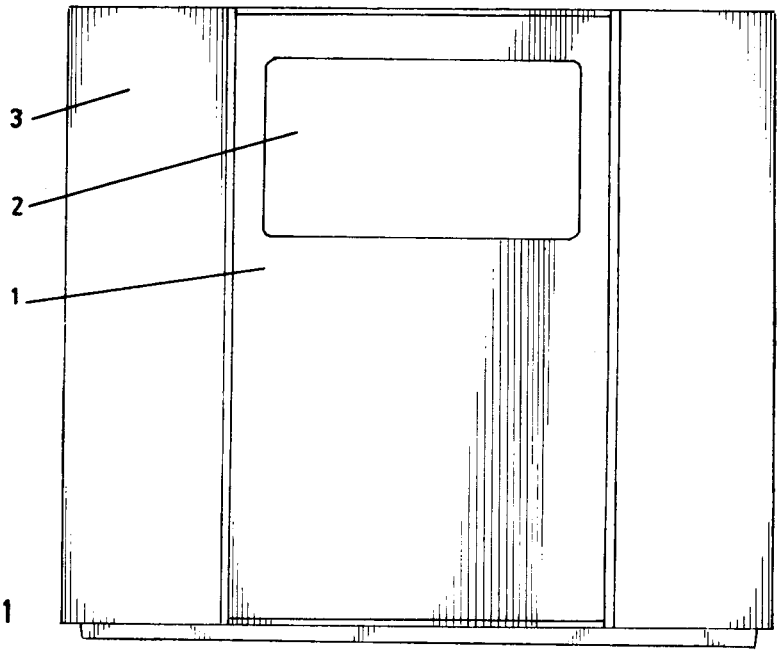
FIG. 1 is a side view of a bottle case.

The embodiment shown in the drawing shows the development of the bottle case in which there are present merely compartment walls extending in one direction and in which therefore the number of bottle compartments is equal to the number of rows of bottles. However, a large number of other embodiments will also be obvious to those skilled in the art.

FIG. 1 is a side view of a bottle case in accordance with the invention. The side wall 1 has a hand-grip hole 2. The corners of the side wall 1 are developed as corner columns which can be noted even from the outside in the form of projections 3.

Figure 2:
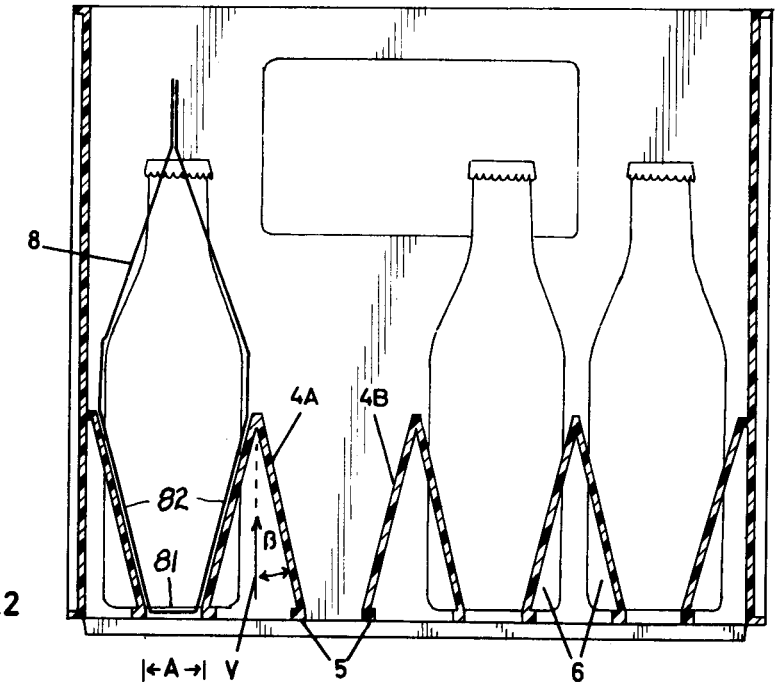
FIG. 2 is a section through the bottle case parallel to the side wall of FIG. 1.

FIG. 2 shows a section through the bottle case parallel to the side wall of FIG. 1. There can be noted here compartment walls 4A, 4B which extend from one side wall 1 to the opposite side wall. At its lower end each of the compartment walls 4 has a continuous rib 5. On these ribs there are supported bottles 6 placed in the bottle case. The compartment walls 4A, 4B form with the vertical V an acute angle $\beta$.

Figure 3:
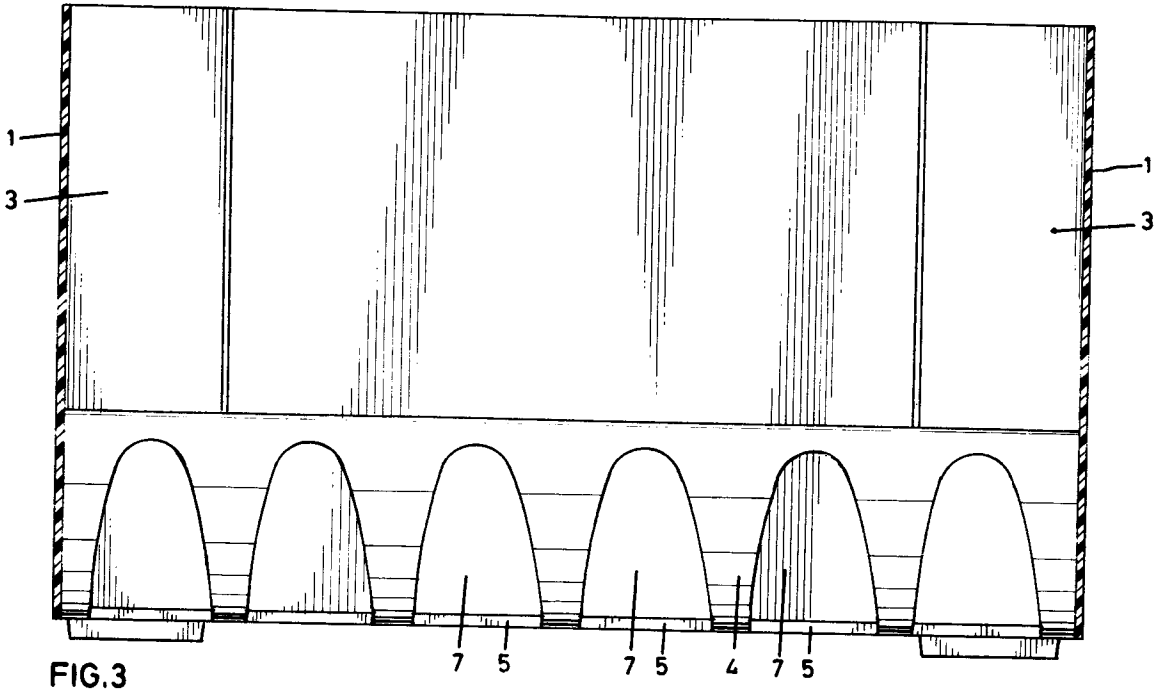
FIG. 3 is a cross section through the bottle case perpendicular to the cross section of FIG. 2.

FIG. 3 shows a cross section through the bottle case which extends perpendicular to the cross section of FIG. 2. Here it can be seen that each compartment wall 4 has cutouts 7 which receive a portion of the lower region of the bottle 6. As a result of these cutouts the shape of which has the form approximately of a parabola, the bottle is assured a dependable hold, so that adjacent bottles cannot strike against each other during transportation.

In FIG. 2 there can be noted in cross section a cardboard carrier 8 which serves to receive a row of bottles. This cardboard carrier 8 has a bottom 81 and two side walls 82. The bottom corresponds to the distance A between the ribs 5 at the lower end of the compartment walls 4A, 4B in width.

The side walls 82 are longer than the bottles 6, since hand-grip holes 83 must still be present above the bottles 6.

Figure 4:
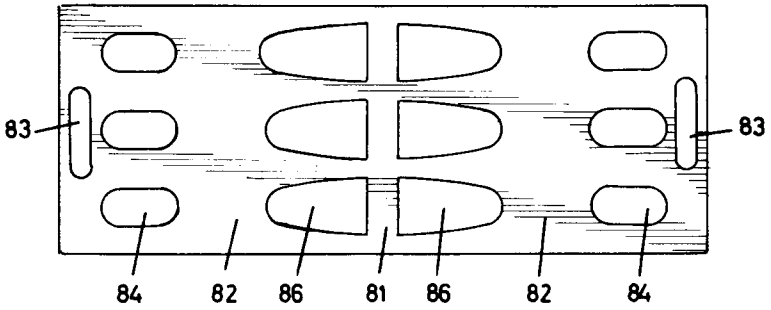
FIG. 4 shows a cardboard blank for a cardboard carrier in which a row of three bottles is adapted to be transported.

FIG. 4 shows a cardboard blank for the cardboard carrier 8 having the bottom 81, the side walls 82 and the hand-grip holes 83. Through the openings 86 there extends a part of the lower body of the bottle, as a result of which the bottle is supported against the walls. The bottom 81 is narrower than the bottom of the bottle; the side walls 82 extend in the lower region up to the upper end of the openings 86 obliquely outward and then move upward snugly fitting the wall of the bottle. Further openings 84 can be provided in order to permit the crown caps of the bottles to pass through said openings 84.

In FIGS. 7 and 8, however, there can also be noted another cardboard carrier 9 in cross section which serves to receive two rows of bottles. This cardboard carrier has two bottoms 91, two side walls 92 and two central walls 93. The bottom corresponds in its width in each case to the distance A between the ribs 5 at the lower end of the compartment walls 4A, 4B.

Figure 5:
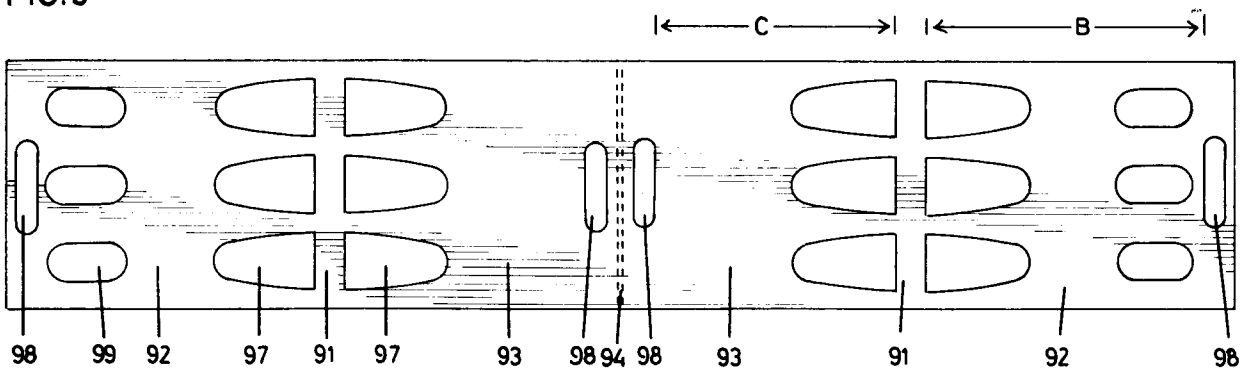
FIG. 5 shows a cardboard blank for a cardboard carrier with which two rows of three bottles each are to be transported.

FIG. 5 shows a cardboard blank for the cardboard carrier 9. The cardboard blank consists of a single piece, folded in the center (indicated in dashed line). The fold line 94 serves for bending by 180°; the two central walls 93 meet at this fold line. Essentially this blank is similar to two attached blanks 8. The blank has two bottoms 91, two central walls 93 and two side walls 92. Parabolic cutouts 97 are provided in the side walls and adjoin the bottom 91. These cutouts are also provided in the central walls. They hold the lower part of the bottles. The side walls 92 are provided in the upper part alongside the hand-grip holes 98 with further cutouts 99 which serve to hold the heads and necks of the bottles.

Figure 6:
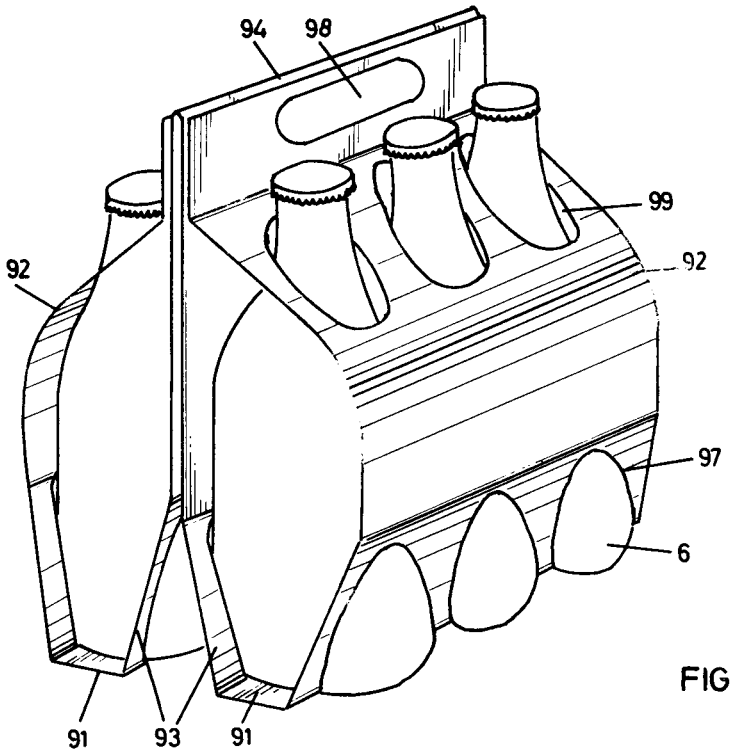
FIG. 6 is a perspective view of the cardboard carrier which is formed from the blank of FIG. 5 and which is filled with bottles.

FIG. 6 is a perspective view of the cardboard carrier 9 suitable for the transportation of two rows of bottles in the condition in which the transportation is effected.

FIG. 7 is a section through a bottle case corresponding to FIG. 2, the cardboard carrier 9 being shown in the lefthand part in the bottle case before it is charged with bottles. In the righthand portion the bottom case has already been filled with bottles. The cardboard carrier 9 has not yet been closed. In this connection the filled bottles can be transported together with the cardboard carriers to the point of sale.

FIG. 8 shows a cross section through the same bottle case, in which connection in the lefthand part of the cardboard carrier 9 has been closed at the point of sale and can now be removed together with the bottles from the bottle case. In the righthand part of this figure it is shown how bottles stand in the bottle case without the cardboard carrier.

Figure 9:
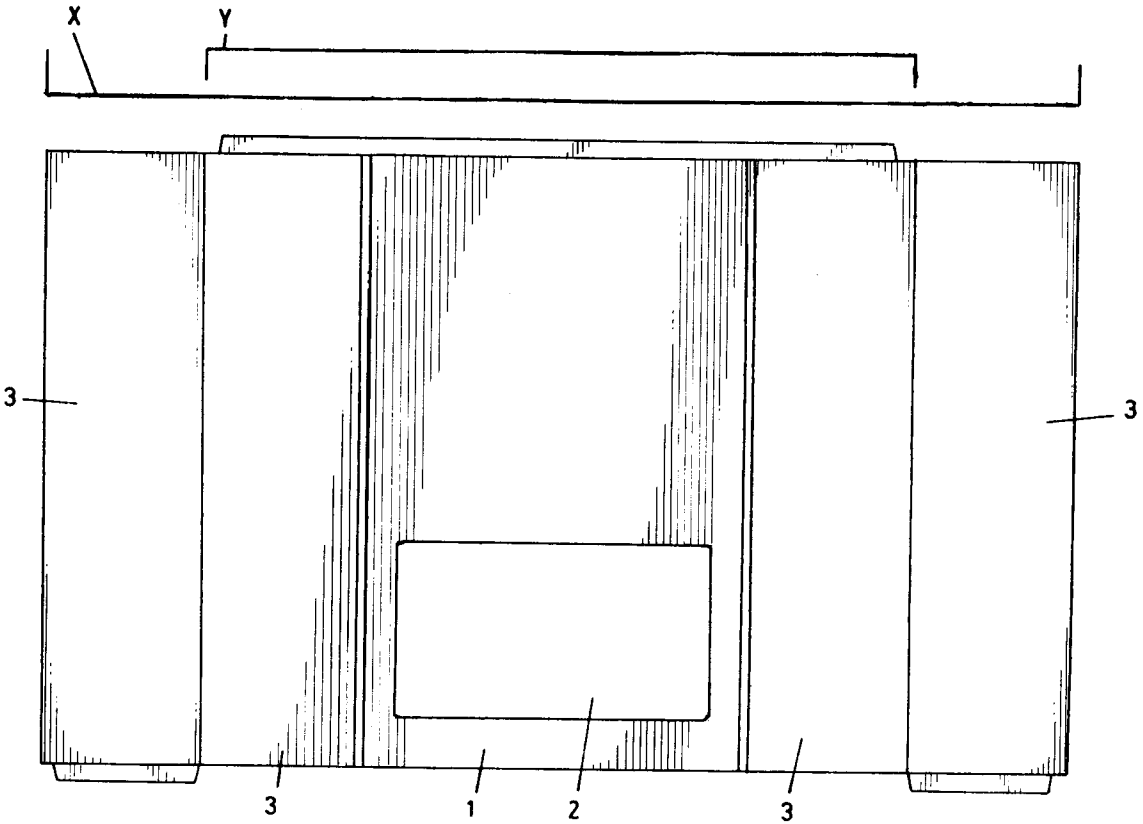
FIG. 9 is a side view of two bottle cases stacked one within the other for transportation when empty.
Figure 10:
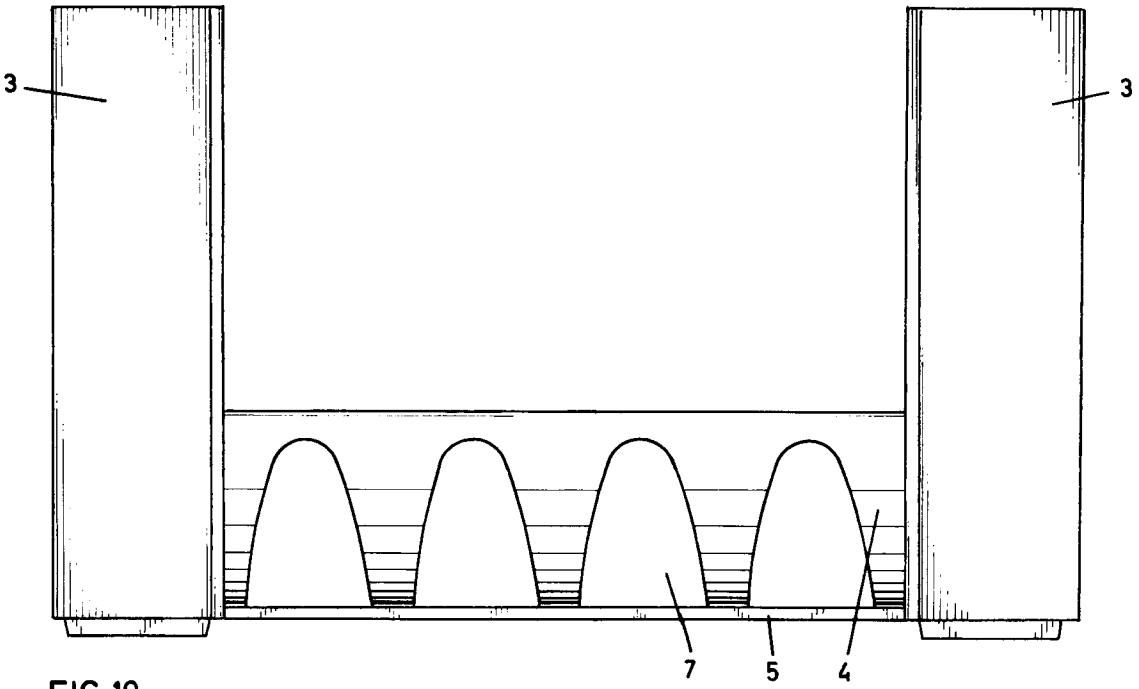
FIG. 10 is a front view of the bottle case.

FIG. 9 is a side view of the two bottle cases nested in each other for empty transportation, a front view of said bottle cases being shown in FIG. 10. Here the bottle cases merely have side walls 1, corner columns 3 and compartment walls 4. Since the compartment walls 4 connect the side walls 1 together, the longitudinal sides have been dispensed with here. Since the compartment walls 4 have only half the height of the side walls 1, the cases can be nested within one another in accordance with the showing of FIG. 9. This can be done particularly well if the distance between two corner columns 3 correspond to the width of a side wall 1.

Figure 11:
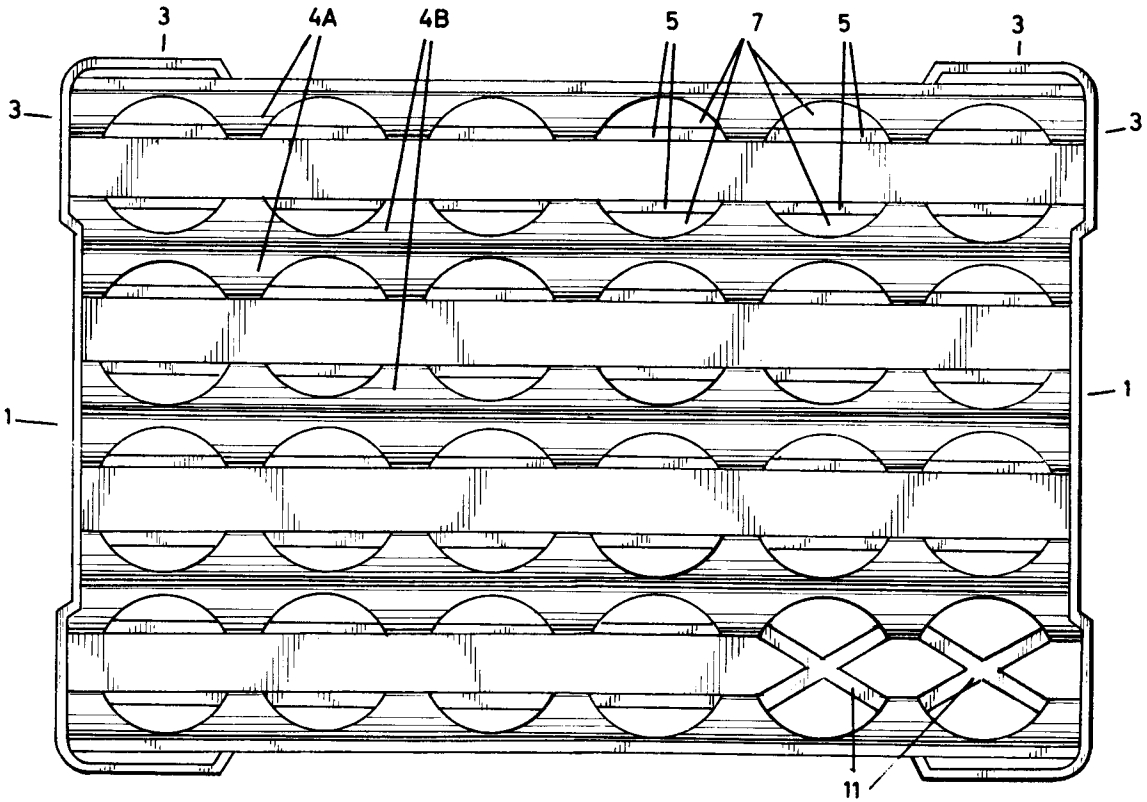
FIG. 11 is a plan view of the bottle case.

FIG. 11 shows a plan view of the bottle case of FIG. 10. In addition to the ribs 5 there are also provided here intersecting transverse ribs 11, on which the bottoms of the bottles come to stand. These transverse ribs 11 are not absolutely necessary. They can be dispensed with. If transverse ribs 11 are present, the ribs 5 can be done away with.

It should also be pointed out in connection with FIG. 5 that the distance B of the hand-grip holes from the bottom at the side walls is greater than the distance away C of the hand-grip holes in the case of the central walls.

Figure 12:
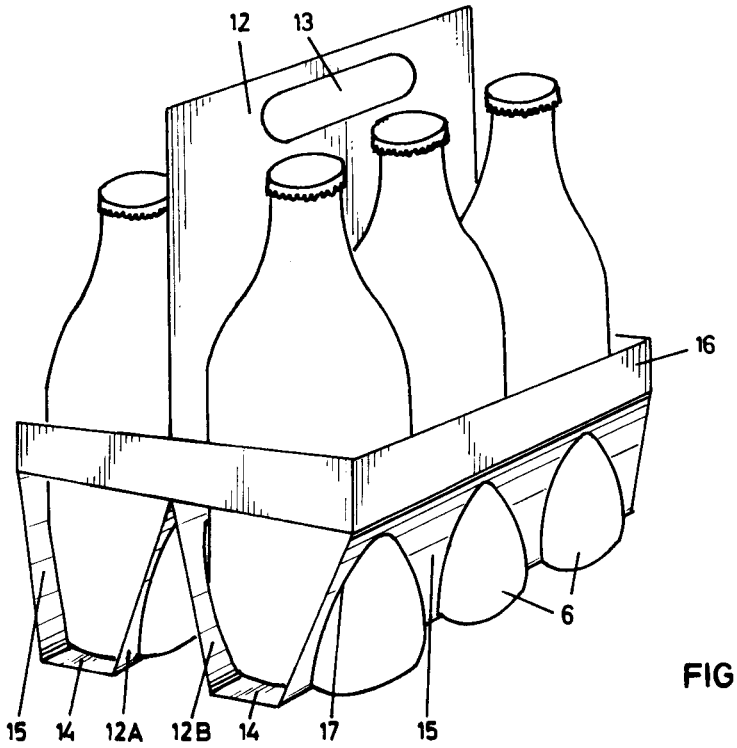
FIG. 12 is a perspective view of a plastic carrier.

FIG. 12 shows in perspective view a plastic bottle carrier. In has a central wall 12 with hand-grip hole 13. Towards the bottom the central wall 12 forks into two parts 12A, 12B in order to adapt itself to the shape of the compartment walls 4A, 4B of the plastic bottle case. Adjoining the parts 12A, 12B of the central wall 12 are two bottoms 14 and adjoining the latter the side walls 15. The side walls extend obliquely upward and outward in the lower region in order also to adapt themselves to the shape of the compartment walls. Towards the top the side walls pass into a strip-shaped part 16 which extends around the entire carrier on all four sides.

Both the lower central-wall portions 12A, 12B and the side walls 15 have openings 17 through which parts of the lower region of the bottles pass. The openings 17 are adapted in position and shape to the openings 7 in the compartment walls 4 of the bottle case. By this arrangement, the bottle carriers 12 which are filled with bottles can be arranged in the plastic bottle cases.

In order to pack the filled bottles, one first of all places the bottle carriers in the bottle case and then insert the bottles.

In FIG. 9 the line X represents the length of a bottle case and the line Y the width of another bottle case placed, crosswise, upside down, over it.

What I claim is:

1. A bottle packing comprising a plastic case having two spaced parallel upright side walls and a plurality of parallel elongate trough-like compartments extending between said side walls, each of said compartments being defined by two downwardly converging inclined walls which at their upper edges are spaced apart a distance greater than the diameter of bottles to be packed and at their lower edges are spaced apart a distance less than said diameter, said inclined walls being of lesser height than said side walls and having in lower portions thereof apertures shaped to receive lower portions of bottles and thereby position bottles apart from one another in said case, means at the lower edges of said inclined walls to support bottles received in said apertures, and a plurality of bottle carriers received in said case, each of said carriers having inclined walls engaging and conforming to said inclined walls of said case with apertures registering with said apertures in the inclined walls of said case to receive said bottles and a bottom to support bottles received in said apertures, whereby said case is adapted alternatively to receive bottles in carriers or individual bottles not in carriers and to position said bottles against lateral displacement whether or not in carriers.

2. A bottle packing according to claim 1, in which said inclined walls of said case are less than half the height of said side walls.

3. A bottle packing according to claim 2, in which said case is rectangular and has only two side walls with column portions at the corners of said case, the other two sides being open except for said corner columns and said inclined walls.

4. A bottle packing according to claim 1, in which pairs of said inclined walls are joined at their upper edges to form in cross section an inverted V-structure.

5. A bottle packing according to claim 1, in which said bottle supporting means of said case comprises reinforcing ribs extending along the lower edges of said inclined walls and across said apertures, the bottom of said case being open except for said supporting means.

6. A bottle packing according to claim 1, in which said bottle supporting means of said case comprise bars extending transversely from one said inclined wall of said case to another below said aperture.

7. A bottle packing according to claim 1, in which each said carrier comprises a rectangular sheet of material of greater length than width and having a narrow transverse central portion forming said bottom, larger portions on each side of said central portion forming said inclined walls and having said bottle-receiving apertures therein, and further portions forming upward extensions of said inclined walls and having therein apertures to receive upper portions of the bottles and matching apertures forming a hand grip for said carrier, said central portion having a dimension lengthwise of said sheet which is less than the diameter of bottles to be packed and said inclined walls and extensions thereof having a combined dimension lengthwise of the sheet greater than the height of said bottles.

8. A bottle packing according to claim 1, in which each said carrier comprises a rectangular sheet of material of much greater length than width and having a central transverse fold line dividing said sheet into two like halves, each of said halves having a narrow transverse central portion forming said bottom of said carrier, larger portions on each side of said central portion forming said inclined walls and having said bottle-receiving apertures therein, and further portions forming upward extensions of said inclined walls and having therein near said fold line and near the respective ends of said sheet apertures to define hand grip portions for said carrier, said sheet being folded on said fold line to form a double carrier for receiving two rows of bottles.

9. A bottle packing according to claim 8, in which portions of said sheet adjacent said fold line form a double central wall of said carrier and portions of said sheet adjacent opposite ends thereof form outer walls of said carrier, said outer walls only being apertured to receive upper portions of bottles in said apertures.

10. An integral molded plastic case for bottles comprising two spaced parallel upright side walls and a plurality of parallel trough-like compartments extending continuously between said side walls, each of said compartments being defined by two downwardly converging inclined walls which at their upper edges are spaced apart a distance greater than the diameter of bottles to be received in said case and at their lower edges are spaced apart a distance less than said diameter, said inclined walls being of lesser height than said side walls and having in lower portions thereof spaced apertures shaped to receive lower portions of bottles and thereby position bottles apart from one another in said case, pairs of said inclined walls between adjacent compartments being joined at their upper edges to form in cross section an inverted V-structure, and means at the lower edges of said inclined walls to support bottles received in said apertures, whereby said case will receive individual bottles and will also receive bottles in carriers having apertured inclined sides conforming to said inclined walls of said case.

11. A bottle case according to claim 10, in which said bottle supporting means comprises reinforcing ribs extending along the lower edges of said inclined walls and across said apertures, the bottoms of said compartments being open.

12. A bottle case according to claim 10, in which said bottle supporting means comprises bars extending transversely between lower edges of said inclined side walls, the bottoms of said compartments being open except for said supporting means.

13. A bottle case according to claim 10, in which said case is rectangular with a greater length than width, said side walls being at the shorter sides of said case, the longer sides of said case being open, whereby two cases can be stacked with one case inverted and turned 90° with respect to the other.

14. A bottle case according to claim 13, comprising corner columns at opposite ends of said side walls and at the four corners of said case.

* * * * *